US005127471A

United States Patent [19]

Weislogel

[11] Patent Number: 5,127,471

[45] Date of Patent: Jul. 7, 1992

[54] PULSE THERMAL ENERGY TRANSPORT/STORAGE SYSTEM

[76] Inventor: Mark M. Weislogel, 23133 Switzer Rd., Brookpark, Ohio 44142

[21] Appl. No.: 736,145

[22] Filed: Jul. 26, 1991

[51] Int. Cl.[5] ..... F28D 15/02

[52] U.S. Cl. ..... 165/104.22; 165/41; 165/104.14; 417/209

[58] Field of Search ..... 165/104.22, 104.29, 165/104.14; 417/207, 208, 209

[56] References Cited

U.S. PATENT DOCUMENTS

| | | | |
|---|---|---|---|
| 3,834,835 | 9/1974 | Jaster et al. | 417/209 |
| 3,887,759 | 6/1975 | Staub et al. | 174/15 R |
| 4,128,123 | 12/1978 | Garriss et al. | 165/104.22 |
| 4,309,148 | 1/1982 | O'Hare | 417/18 |
| 4,431,385 | 2/1984 | O'Hare | 417/379 |
| 4,699,754 | 10/1987 | French | 376/299 |
| 4,921,041 | 5/1990 | Akachi | 165/104.22 |
| 4,930,570 | 6/1990 | Okayasu | 165/104.14 |
| 4,986,348 | 1/1991 | Okayasu | 165/104.24 |

*Primary Examiner*—Albert W. Davis, Jr.
*Attorney, Agent, or Firm*—Gene E. Shook; James A. Mackin; Guy M. Miller

[57] ABSTRACT

A pulse-thermal pump having a novel fluid flow wherein heat admitted to a closed system raises the pressure in a closed evaporator chamber while another interconnected evaporator chamber remains open. This creates a large pressure differential, and at a predetermined pressure the closed evaporator is opened and the opened evaporator is closed. This difference in pressure initiates fluid flow in the system.

7 Claims, 7 Drawing Sheets

PULSE THERMAL ENERGY TRANSPORT/STORAGE SYSTEM

ORIGIN OF THE INVENTION

The invention described herein was made by an employee of the U.S. Government and may be manufactured and used by or for the Government for governmental purposes without the payment of any royalties thereon or therefor.

TECHNICAL FIELD

This invention is concerned with an improved thermal energy transport system. The apparatus is particularly directed to a pulse thermal energy transport and a storage system.

Many passive heat transport systems have been proposed. The prior art systems are limited to relatively low heat transport, dissipation, and storage. Future space operation will definitely require systems of higher efficiency with regards to performance, mass, simplicity, and expense.

It is, therefore, an object of the present invention to provide an improved passive or semi-passive pulse thermal energy transport and/or storage system.

Another object of the invention is to provide such a thermal energy transport system in which the circulating fluid is not constrained by capillary pumping.

A still further object of the invention is to provide a thermal energy transport system and/or storage system having at least an order of magnitude increase in heat dissipation rate for a system of comparable size, mass, and simplicity of operation.

BACKGROUND ART

U.S. Pat. No. 4,930,570 to Okayasu describes the thermal pump used to cool electronic devices. The cooling rate must be high and the radiating surface must be small to accommodate space requirements in an aircraft. A thermal pump is used to increase heat dissipation while eliminating the conventional pump and the space it requires.

U.S. Pat. No. 4,986,348 to Okayasu describes a heat conducting device which is based on the same principle as the aforementioned Okayasu patent. However, the second patent is not directed to aircraft applications, but to more general heat pipe applications.

U.S. Pat. Nos. 4,309,148 and 4,431,385 to O'Hare are directed to structures which utilize a solar heat source. The first patent discloses a solar water heater in which solar radiation is collected within a chamber that is a component of a recirculating water system. The second patent makes use of the flash heating principle where a heat collector is permitted to preheat in a dry state. Water is then dropped onto the hot plate causing a stream to be rapidly generated. Pressure differentials provide the motive force. The pulsing rate is dependent on the amount of heat present in the collection region.

DISCLOSURE OF THE INVENTION

The aforementioned objects are achieved by a pulse/-thermal pump having a novel flow device. More particularly, the apparatus of the present invention comprises a plurality of heat absorbers, radiators, and flow control valves. A pressure gradient is created by iterative operation of certain valves in the cycle.

In operation, heat is admitted into the system and one flow control valve is open while the second remains closed. The closed heat absorber has no condensation and has a small volume in comparison with the open section. This creates a pressure differential.

At a predetermined pressure differential, the first valve is opened while the second valve is closed. The difference in pressure initiates fluid flow in the system. The fluid driving pressures generated can exceed typical capillary pressure driven systems by several orders of magnitude.

BRIEF DESCRIPTION OF THE DRAWINGS

The objects, advantages and novel features of the invention will be more fully apparent from the following detailed description when read in connection with the accompanying drawings in which like numerals are used throughout to identify like parts.

BEST MODE FOR CARRYING OUT THE INVENTION

The apparatus of the present invention operates on a cycle which utilizes the increasing pressure of a closed system generated by a heat source to drive an energy transport fluid to a heat rejection system where the energy can be stored or exchanged. While it is preferable to operate the device in a low gravity environment it will also function at normal gravity.

Figure 1:
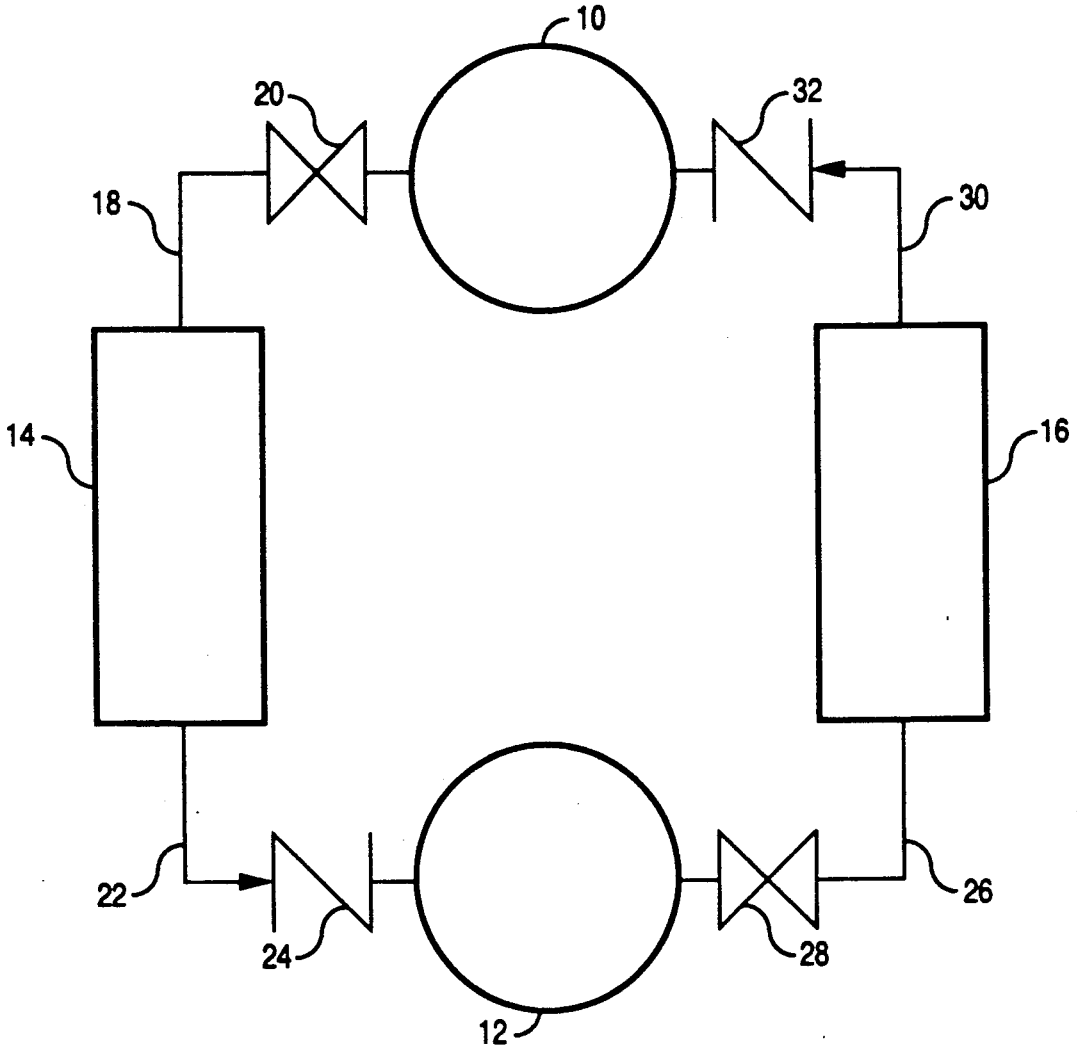
FIG. 1 is a simplified schematic of a pulse loop apparatus constructed in accordance with the present invention.

A simplified schematic of the apparatus is shown in FIG. 1. The apparatus includes a pair of evaporators 10 and 12. These evaporators are in the form of vaporization chambers where a transport fluid is heated by the input of thermal energy.

A pair of condensers 14 and 16 are positioned between the evaporators. The heated transport fluids from the evaporators are cooled in the condensers and heat is released.

A conduit in the form of a pipe 18 connects the condenser 10 to the evaporator 14 so that heated transport fluid can flow from the evaporator to the condenser. This flow in the pipe 18 is regulated by a suitable control valve 20, such as a gate valve.

Another conduit in the form of a pipe 22 connects the condenser 14 to the evaporator 12 so that the cooled transport fluid can flow from the first condenser to the second evaporator. Backflow of the transport fluid from the evaporator 12 to the condenser 14 is prevented by a check valve 24 in the pipe 22.

A third conduit in the form of a pipe 26 facilitates the flow of the transport fluid from the second evaporator 12 to the second condenser 16. The passage of fluid in the pipe 26 is regulated by a control valve 28 which operates in a manner similar to that of valve 20.

A fourth conduit in the form of a pipe 30 connects the second condenser 16 to the first evaporator 10. A check valve 32 in the pipe 30 prevents back flow of the transport fluid from the first evaporator 10 to the second condenser 16.

Figure 2:
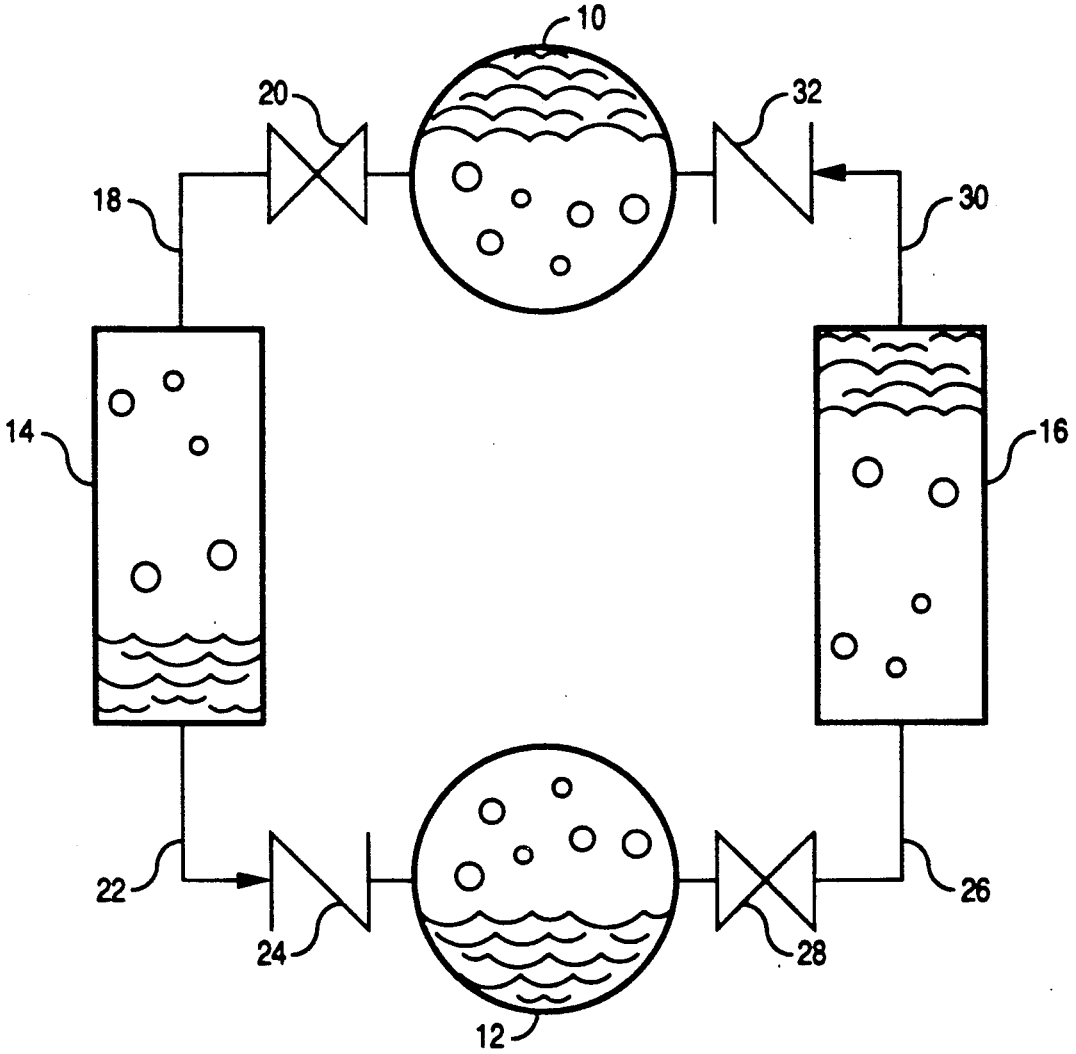
FIGS. 2–6 are schematics of the pulse loop shown in FIG. 1 illustrating the operation of a pulse thermal cycle.

Step by step operation of the system shown in FIG. 1 is illustrated in FIGS. 2 through 6. The process begins with stagnant liquid shown in the shaded regions and vapor elsewhere, both at saturation conditions, as shown in FIG. 2.

Figure 3:
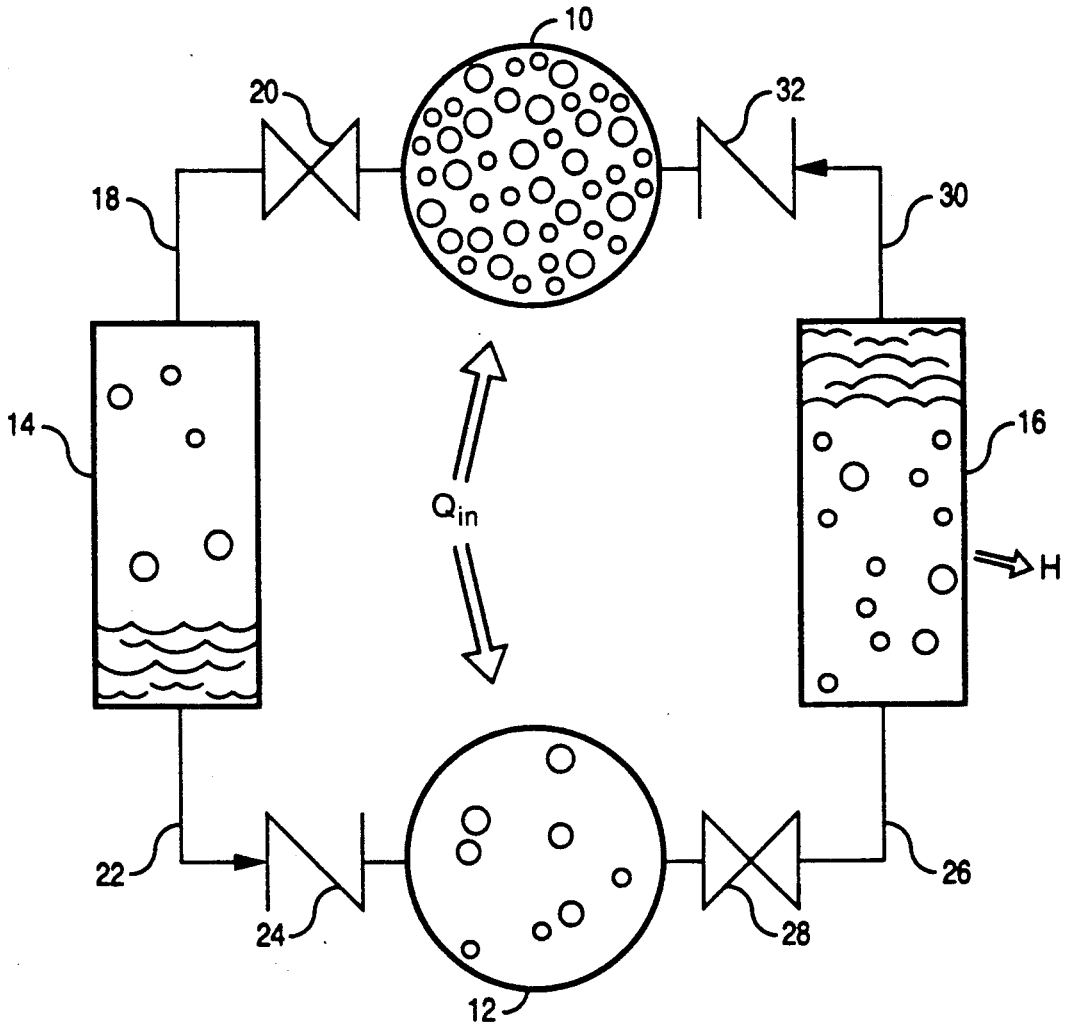

Heat is then supplied to the evaporators 10 and 12 as shown by the arrow Q in FIG. 3. With the valve 20 closed and the valve 28 open the pressure in the evaporator 10 increases above that in the evaporator 12. Because the vapor generated in the evaporator 12 is permitted to condense in the condenser 16, heat is rejected as indicated by the arrow H as shown in FIG. 3.

Figure 4:
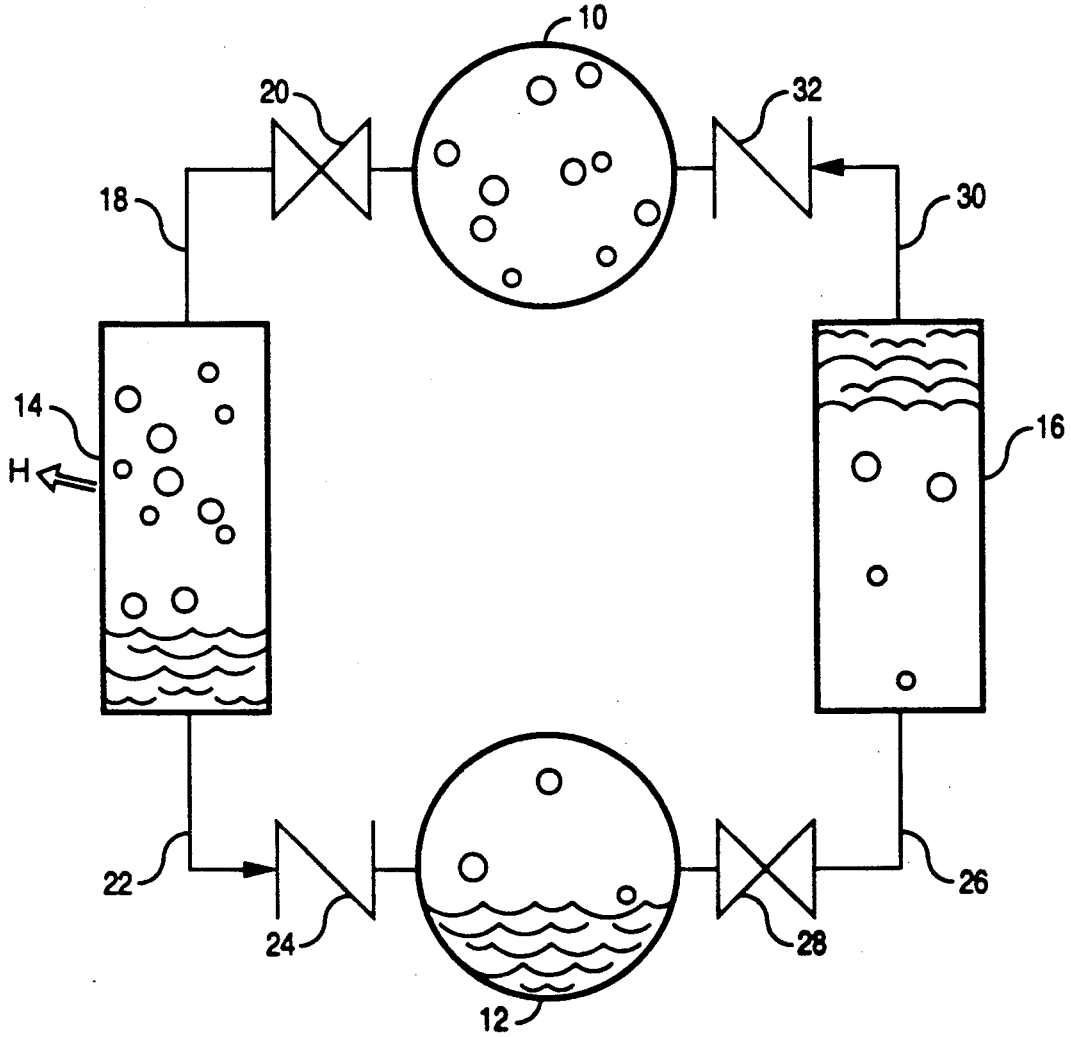

At some prescribed differential pressure the valve 20 is opened and the valve 28 is closed as shown in FIG. 4. The flow of hot transfer fluid at higher pressure proceeds from the evaporator 10 to the condenser 14 where heat is rejected as shown by the arrow H. The flow of hot fluid at the higher pressure from the evaporator 10 to the condenser 14 forces compressed liquid through the check valve 24 into the evaporator 12 as shown in FIG. 4.

Figure 5:
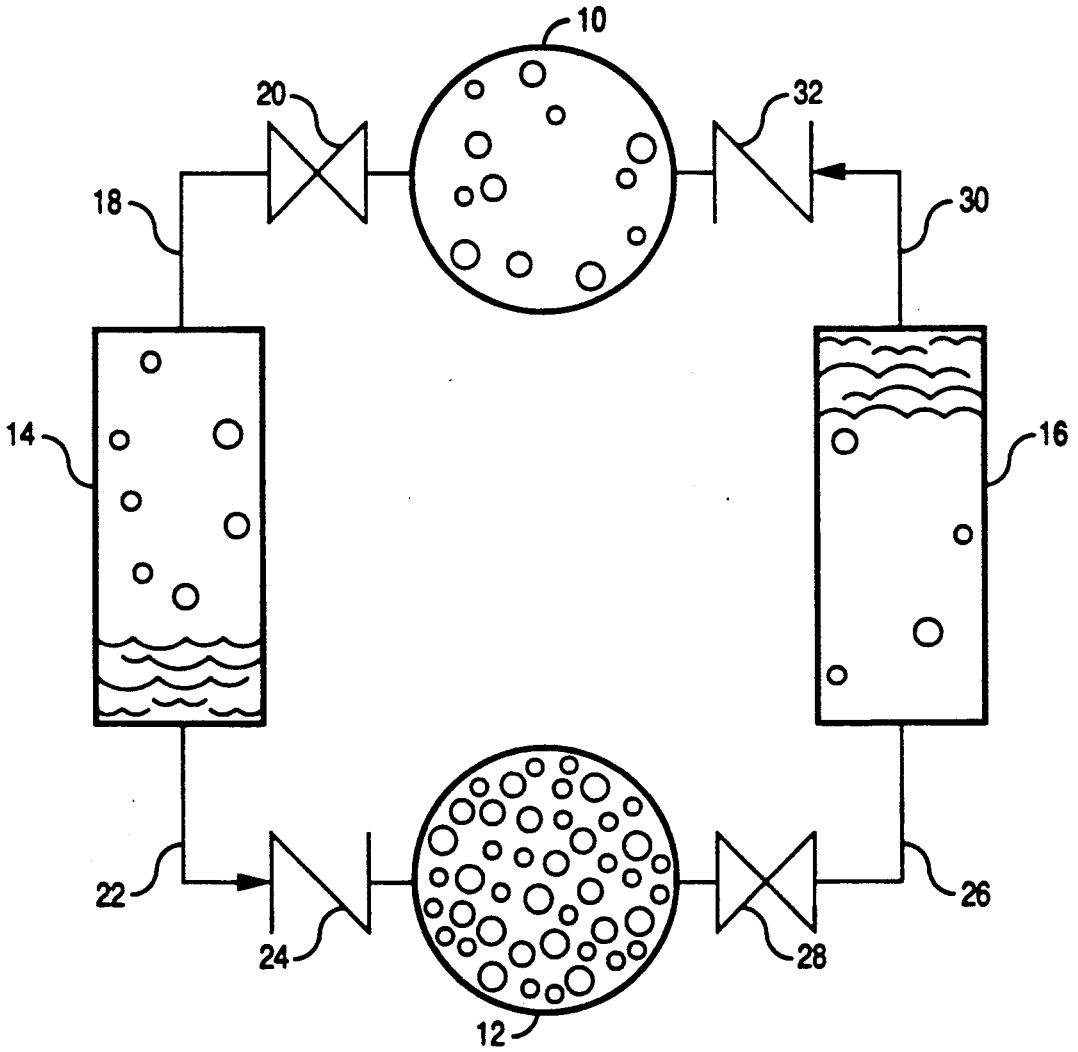

This injected liquid in turn vaporizes as shown in FIG. 5. Because the evaporator 12 is now sealed by the control valve 28 and the check valve 24 and the evaporator 10 is opened to the condenser 14, the pressure in the evaporator 12 increases over that of the evaporator 10 as shown in FIG. 5.

Figure 6:
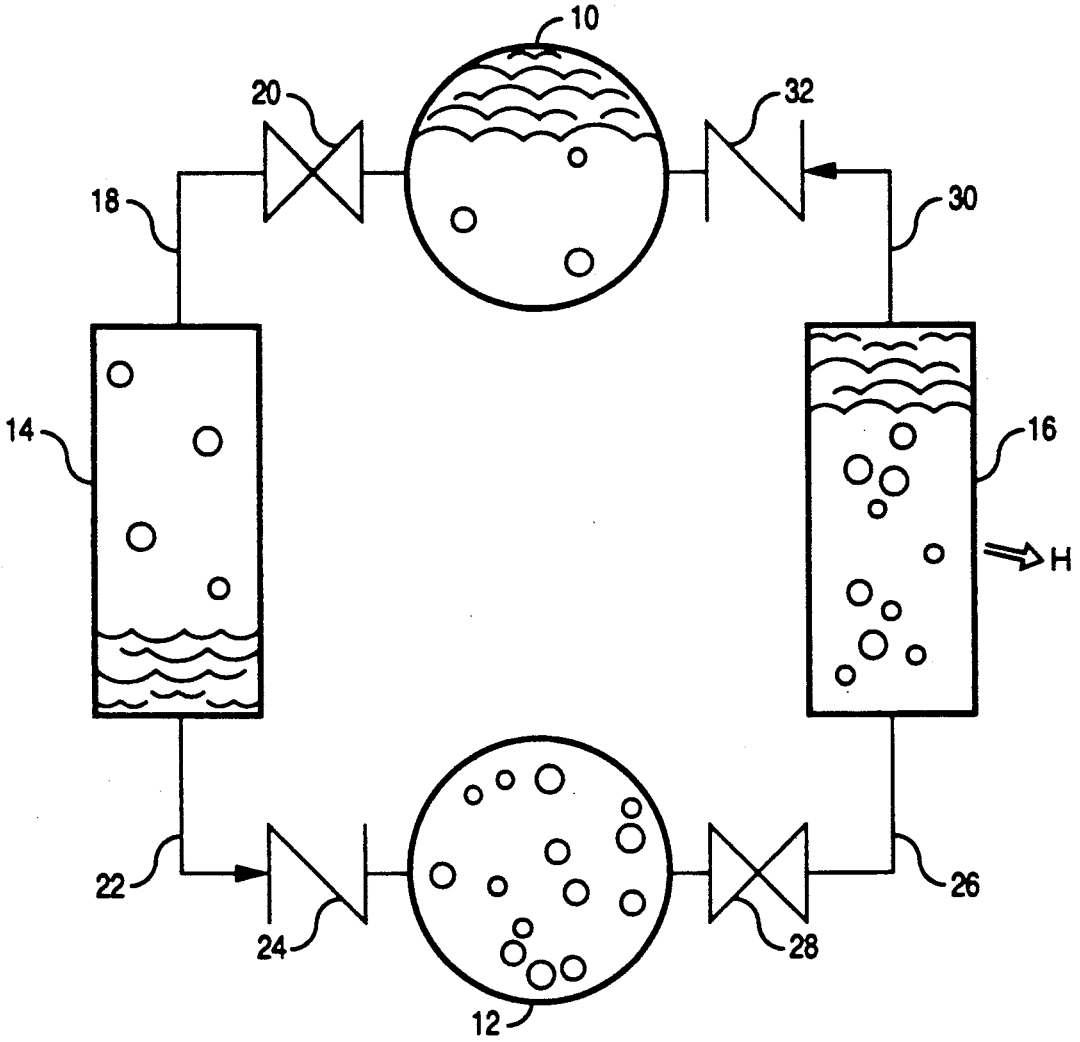

Again at some prescribed pressure difference the control valve 20 is closed and the control valve 28 is opened as shown in FIG. 6, and the cycle is repeated. The process will continue as long as the heat source Q is present. In the event the transport fluid is entirely vaporized the system will continue to function albeit at higher temperatures. Because iterative control of the control valves 20 and 28 is required, this system is termed semi-passive.

Figure 7:
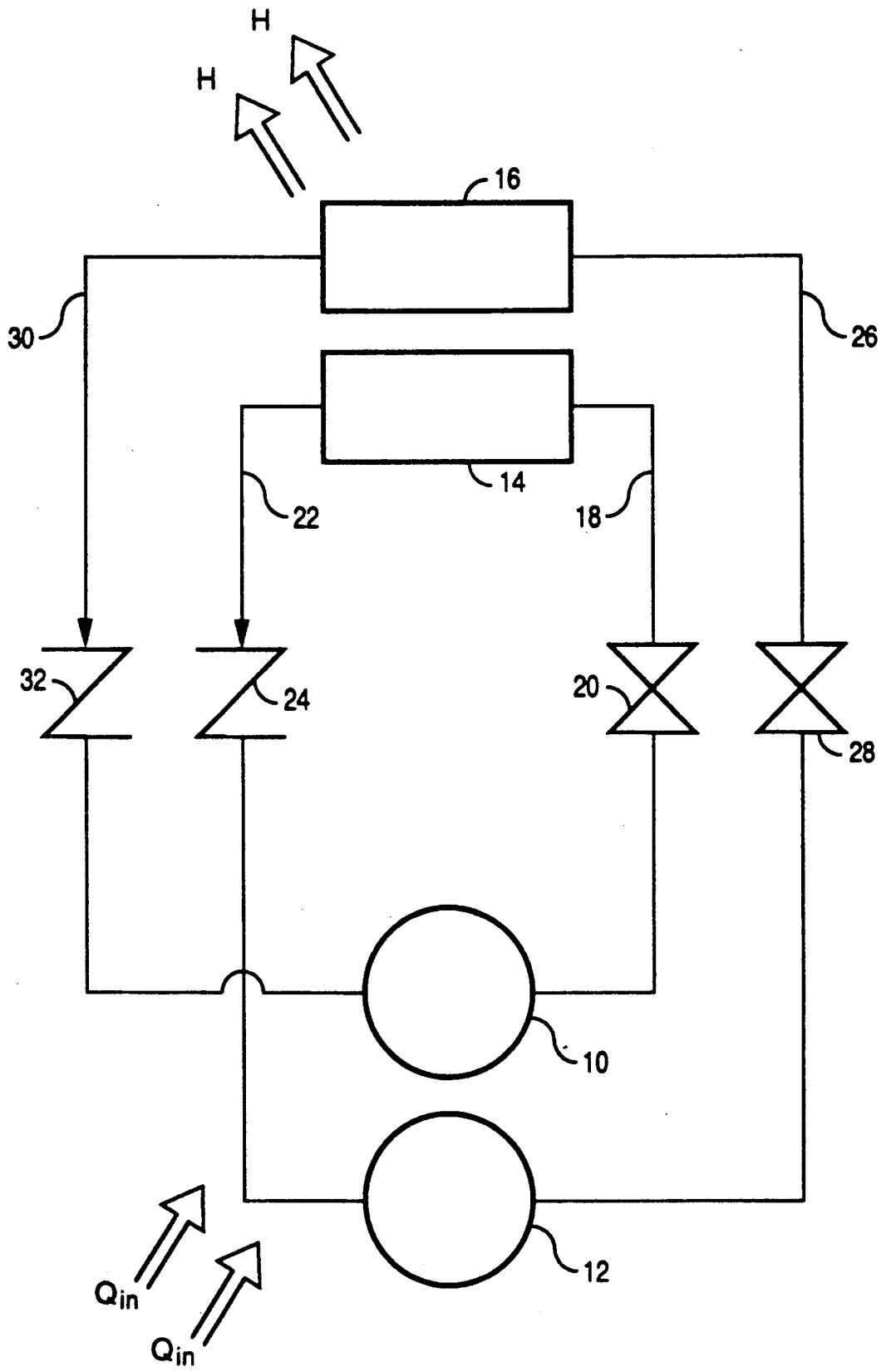
FIG. 7 is a schematic of a pulse loop illustrating a preferred embodiment of the invention.

Referring now to FIG. 7 there is shown a schematic of a system constructed in accordance with the invention having the various components numbered as in FIGS. 1-6. An important novel feature of the system is the use of heat to provide iterative pumping power to the working or circulating fluid. In many cases this heat is waste heat.

Specific components of the system shown in FIG. 7 may comprise a pre-existing item, such as valves and controls. However, the integration of essentially two thermal cycles into one which operates locally transient yet globally steady is an important feature of the invention.

While a preferred embodiment of the invention has been shown and described it will be appreciated that various modifications may be made to the structure without departing from the spirit of the invention or the scope of the subjoined claims.

I claim:

1. In apparatus for transporting heat wherein a fluid heated in an evaporator portion flows to a condenser portion where it is cooled prior to flowing to another evaporator portion, the improvement comprising a first evaporator for heating said fluid, a first condenser for cooling said heated fluid from said first evaporator, first conduit means for transporting said heated fluid from said first evaporator to said first condenser, a first gate valve in said first conduit means for selectively controlling the flow of heated fluid from said first evaporator to said first condenser, a second evaporator for receiving the said cooled fluid from said first condenser and heating the same, second conduit means for transporting said cooled fluid from said first condenser to said second evaporator, a first check valve in said second conduit means for limiting the flow of said cooled fluid to a direction from said first condenser to said second evaporator, a second condenser for cooling said heated fluid from said second evaporator, third conduit means for transporting said heated fluid from said second evaporator to said second condenser, a second gate valve in said third conduit means for selectively controlling the flow of heated fluid from said second evaporator to said second condenser, fourth conduit means for transporting said cooled fluid from said second condenser to said evaporator, a second check valve in said fourth conduit means for limiting the flow of said cooled fluid to a direction from said second condenser to said first evaporator, and means for providing iterative control of said first gate valve and said second gate valve whereby the apparatus is semi-passive.

2. A pulse method of transporting thermal energy with a heat transfer fluid contained in a closed system of chambers n communication with one another including a plurality of evaporator chambers having condenser chambers interposed therebetween and connected thereto, said method comprising closing the communication between one of the evaporator chambers and the connected condenser chambers to that fluid flow from said one evaporator chamber to said connected condenser chambers is inhibited, heating of the fluid in said one closed evaporator chamber so that the pressure thereof increases to a first pressure, placing said one evaporator chamber in communication with one of said condenser chambers when said fluid in said evaporator chamber reaches said first pressure thereby creating a pulse whereby fluid from said one evaporator chamber at said first pressure forces fluid in said one condenser chamber at a second pressure that is less than said first pressure into another evaporator chamber connected thereto, closing the communication between said other evaporator chamber and the connected one condenser chamber and another condenser chamber, cooling said fluid in said one condenser chamber while heating said fluid in said other evaporator chamber to sid first pressure, and opening the communication between the other evaporator chamber and said other condenser chamber simultaneously with the closing of the communication between said one evaporator chamber and said other condenser chamber whereby the pulse is produced thereby providing interative pumping by integrating two thermal cycles into one.

3. A pulse method as claimed in claim 2 wherein the heat transfer fluid in the one closed evaporator chamber is heated to the gaseous state.

4. A pulse method as claimed in claim 3 wherein a heat transfer gas flows from the one evaporator chamber to the one condenser chamber.

5. A pulse method as claimed in claim 4 wherein the heat transfer fluid in the one condenser chamber is cooled to a liquid state.

6. A pulse method as claimed in claim 5 wherein the heat transfer liquid is forced from the one condenser chamber by the heat transfer gas from the one evaporator chamber.

7. A pulse method as claimed in claim 2 including the steps of opening the communication between the other evaporator chamber and a connected condenser chamber simultaneously with the closing of the communication between said one of the evaporator chambers and said connected condenser chamber.

* * * * *